US006719437B2

(12) United States Patent
Lary et al.

(10) Patent No.: US 6,719,437 B2
(45) Date of Patent: Apr. 13, 2004

(54) HEAD APPARATUS WITH LIGHT EMITTING DIODES

(76) Inventors: Banning Lary, 6280 Sunset Dr., Suite 411, Miami, FL (US) 33143; Todd Pendleton Lary, 14870 SW. 238th St., Homestead, FL (US) 33032

( * ) Notice: Subject to any disclaimer, the term of this patent is extended or adjusted under 35 U.S.C. 154(b) by 0 days.

(21) Appl. No.: 09/841,850

(22) Filed: Apr. 25, 2001

(65) Prior Publication Data

US 2002/0186557 A1 Dec. 12, 2002

(51) Int. Cl.[7] ..... F21V 21/84

(52) U.S. Cl. ..... 362/106; 362/230; 362/190; 2/209.13

(58) Field of Search ..... 362/106, 105, 362/191, 263, 396, 190, 293, 800, 230, 231; 2/208.13, 175.1, 906

(56) References Cited

U.S. PATENT DOCUMENTS 5,386,592 A * 2/1995 Checkeroski ..... 362/105
5,485,358 A * 1/1996 Chien ..... 362/106
5,567,038 A * 10/1996 Lary ..... 362/106
5,738,431 A * 4/1998 Lary ..... 362/106
5,911,494 A * 6/1999 Lary ..... 362/106
6,095,661 A * 8/2000 Lebens et al. ..... 362/184
6,250,769 B1 * 6/2001 Kirk ..... 362/106

* cited by examiner

*Primary Examiner*—Sandra O'Shea
*Assistant Examiner*—Bao Q. Truong
(74) *Attorney, Agent, or Firm*—Michael E. Klicpera

(57) ABSTRACT

The current invention utilizes the common baseball-type hat or headband, to which is attached one or more arrays of light emitting diodes. It is the object of this invention to provide an efficient lighting apparatus which embodies the principles of an adjustable hat or headband worn on the head, to which a battery-powered light emitting diodeing apparatus is either permanently attached to the hat or headband, or removable attached to the hat or headband by a hook and loop concept.

18 Claims, 3 Drawing Sheets

FIG. 4
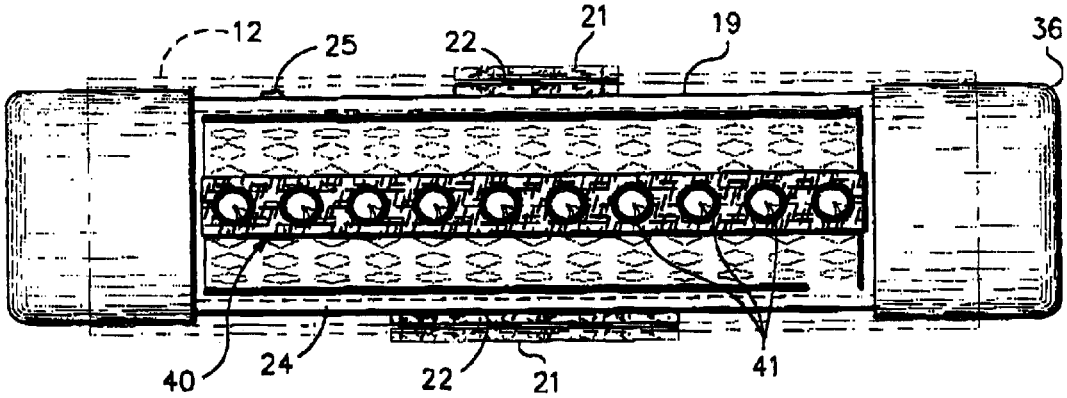
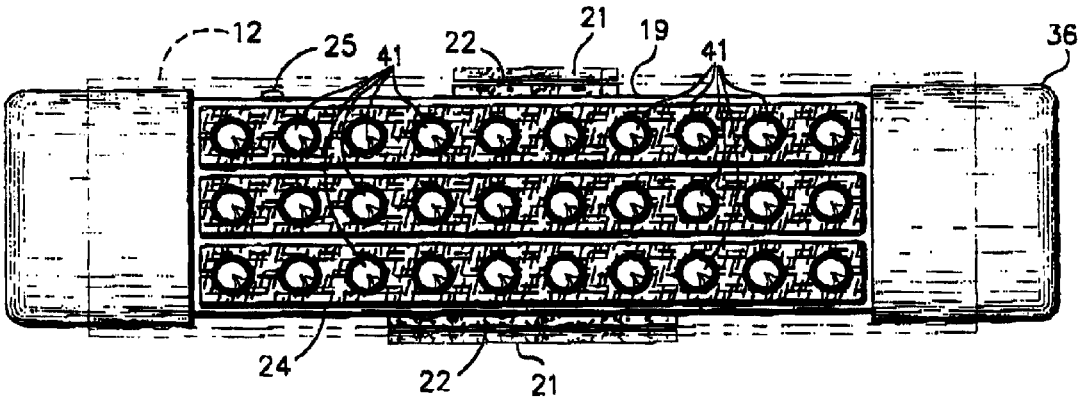
FIG. 5

HEAD APPARATUS WITH LIGHT EMITTING DIODES

BACKGROUND OF THE INVENTION

The invention relates generally to a head apparatus or hat with light-emitting diodes (LEDs) mounted thereon which functions to illuminate dark areas and permits freedom of both hands and feet to perform various actions with greater efficiency and safety.

Illumination by lighting apparatuses attached to a hat have long been used by mankind to improve his efficiency. Goya, in the 17th Century, placed candles around the hat to achieve a flickering light which gave an effect he sought to transfer to his paintings. The common miner's hat of the Industrial Revolution made extensive use of the carbide lamp attached to the hat for working in mineral mines and for cave explorations as well. The dry cell battery, the rechargeable, and lithium batteries are currently used in various types of headlights, which are usually spotlights. Such lights are frequently attached to hard hats and to various devices which encircle the head in a band-like fashion. These lights generally have a relatively narrow beam of the flashlight type, which beams can be focused to a given area by a reflector and a focusing lens. This limitation of general illumination of a wide area is characteristic of such head-lighting apparatuses. In addition, if one wished to place the light in another location, the supporting member must be removed from the subject.

Light emitting diode (LED) technology has progressed to a point where this technology can be advantageous in the present invention. It has been demonstrated that LEDs convert electricity to colored light more efficiently than incandescent type lights. More specifically, it has been reported that for red light, LEDs are 10 times more efficient. Furthermore, LEDs are more rugged and compact, some types last about 100,000 hours in contrast to the average 1000 hours for a typical incandescent light bulb.

SUMMARY OF THE INVENTION

The current invention utilizes the common head apparatus, for example a baseball-type hat or headband, to which attached is a plurality or array of light emitting diodes (LEDs). The LEDs are positioned such that when the hat is properly worn, light is projected substantially forward.

LED technology has progressed to the point where brightness and battery efficiency are practical for many uses, including this present invention. This LED technology has advanced in recent years, where high-brightness of all color spectrums has been achieved. Because each individual LED emits one distinct hue, users have more control of the light waves displayed over the full spectrum. By employing differently colored LEDs together in an array, the user can adjust the combined light. The plurality or array of LEDs may therefore comprise a single color band or use various color bands to result in a synthesized color.

White light can be generated by using red, green and blue LEDs which can be adjusted to feel "cooler" by turning off more of the red LEDs and/or turning on more of the blue ones. Furthermore, this flexibility extends to situations where a particular color is preferred, such as in aviation, where red light is used for viewing instruments and maps. In these applications, white incandescent, fluorescent, or halogen light must employ a colored filter to achieve the desire wavelength of light. Filtering of light for these purposes can have a negative effect on brightness.

It is one of the objects of this invention to provide an efficient lighting apparatus which embodies the principles of an adjustable hat or headband worn on the head, to which a battery-powered light emitting diode (LED) lighting apparatus is attached either 1) permanently to the hat or headband or 2) removably by employing hook and loop technology. The light emitting diode(s) requires a small amount of electrical current and illuminates a larger area with a brighter illumination and more color control than prior customary light technology.

The design of the apparatus permits diverse tasks to be easily performed, and increases the safety of all movements in the dark. It is particularly advantageous to pilots of aircraft and engineers to illuminate instrument panels in emergency situations when darkness prevails. Applications can be found anyplace a light is beneficial for convenience and pleasure.

It is further the object of this invention to permit easy removal of the light emitting diode(s) apparatus for illumination in a stand-alone mode or with an additional attachment mechanism.

A further object of the invention is to permit the attachment of various arrays of LEDs to change the color, or increase/decrease the intensity of the illumination. For example, an array of red LEDs may be employed to prevent loss of light vision in dark areas.

A further object is to permit the light to be elevated for diffuse illumination of a specific area, or concentrated to a smaller area closer to the operator, such as when examining a specific object or reading.

BRIEF DESCRIPTION OF THE DRAWINGS

FIG. 4 is a front elevation of an embodiment of the present invention 10 showing a single array of light emitting diodes positioned, facing forward, in lighting of device 11.

FIG. 5 is a front elevation of an alternate embodiment of the present invention 10 showing multiple array of light emitting diodes positioned, facing forward, in lighting device 11.

DESCRIPTION OF THE PREFERRED EMBODIMENT

Figure 1:
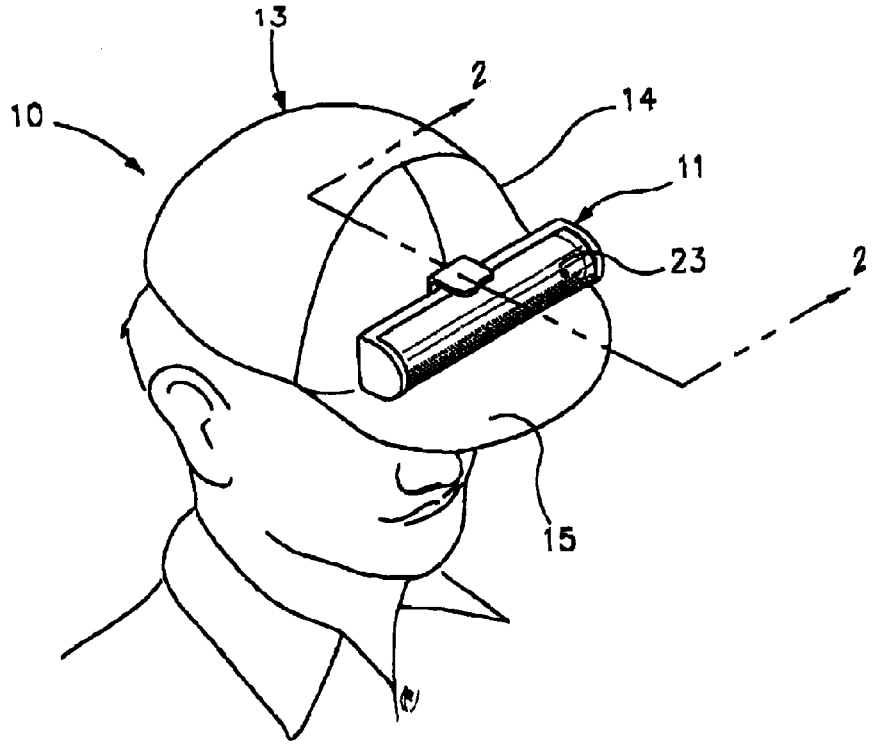
FIG. 1 is a perspective view of apparatus 10 consisting of an adjustable hat 13 with an array of light emitting diodes (LEDs) contained in a housing 11.

The novel features of this invention, as well the invention itself, both as to its structure and its operation, will best be understood by the accompanying drawings, taken in conjunction with the accompanying description in which similar reference characters refer to similar parts, and in which:

FIG. 1 illustrates the device 10 comprising an adjustable hat 13 to which is permanently attached a lightning device 11 that contains one or more arrays of light emitting diode(s) (LEDs). Because each individual LED emits one distinct hue, the array of lighting device 11 can have more control of the light waves displayed over the full spectrum. By employing differently colored LEDs together in the array, the user can adjust the combined light. Therefore, the array of LEDs may comprise a single color band or use various color bands to result in a synthesized color. For example, typical white light can be generated by employing a combination of red, green, and blue LEDs. Furthermore, the number of LEDs having a particular color emitting spectrum in the array can be adjusted to "feel cooler" by turning off more of the red LEDs and/or turning on more of the blue ones. Conversely, a particular color emitting spectrum in the array can be adjusted to "feel hotter" by turning on more of the red LEDs and/or turning off more of the blue ones. In addition, this flexibility extends to situations where a particular color is preferred, such as in aviation, where red light is used for viewing instruments and maps at night. In these applications, white incandescent, fluorescent, or halogen light must employ a colored filter to achieve the desire wavelength of light. Filtering of light for these purposes may have a negative effect on brightness. A transparent lens cover 23 may be employed to protect the LEDs from potential damage. It is completed that further enhancement of the light spectrum emanating from the LED array may be accomplish by employing a transparent colored lens cover 12 which is removably attached to the body of the lighting device 11. In this embodiment, the lighting device 11 is permanently attached to a part of the crown 14 and the bill 15 of the hat 13. Not shown is the concept of permanently attaching the LED lighting device 11 permanently to a headband.

Figure 2:
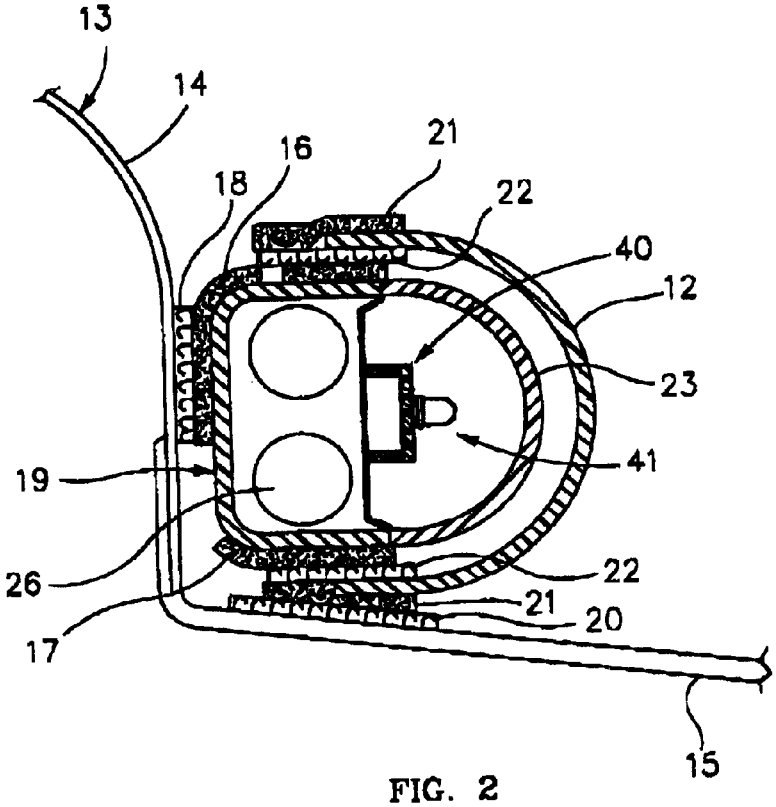
FIG. 2 is a sectional view of the light device 11, showing an alternated embodiment of the present invention employing hooks and loops used to removably join the LED lighting device 11 to crown 14 and bill 15.

FIG. 2 illustrates another embodiment the device 10 which is an adjustable hat 13, to which is removable attached a lightning device 11 containing one or more arrays of light emitting diodes (LEDs) 41. Further illustrated in FIG. 2 is that the lighting device 11 is also composed of a housing 19, transparent lens shield 23 and batteries 26. The array of LEDs are mounted on a substrate 40 that uses technology already known in the prior art, such as hard fiber or resin treated boards. The substrate boards 40 may contain an electrical conduction means to facilitate the connection of individual diodes in the array. The electrical connections and switches 25 between the diodes and power source (battery) is technology already known in the prior art and not particularly important to the present invention.

FIG. 2 also shows in more detail the method for removably attaching the lighting device 11 to the crown 14 and the bill 15 of the hat 13. Flexible segments of loops 16 are adhesively attached to part of the top and back of the lighting device 11. Similarly, additional segments of loops 17 are attached to the bottom of the lighting device 11. The loops 16 attach to the hooks 18 sewn or adhesively attached by to the crown 14 of the hat 13 and the segment of loops 17 attach to the segment of hooks 20 sewn to the bill 15 of the hat 13. FIG. 2 also illustrates segments of loops 21 adhesively attached to a portion of the center area of the top of the lens cover 12. These loops, being of a softer consistency then the hooks, serve as a convenience in the attachment and detachment of various removable pieces. Directly opposing the loops 21 and attached partially to both the adhesive backing of loops and the lens cover is found a segment of hooks 22 which engage the segment of loops 16 and 17 on the lighting device 11.

Further study of FIG. 2 will reveal the segment of loops 16 and 17 engage the segment of hooks 22 and the segment of loops 21 engage the segment of hooks 20, thus securing the lens cover 12 to the body of the lighting device 11 and to the bill 15 of the hat 13. The segment of loops 21 is of small thickness and of limited length, so that it has minimal interference with the attachment of the segment of loops 17 to the segment of hooks 20. It will be observed that when the subject uses pressure on the lighting device 11 to release the loops 16 from the hooks 18, the bill 15 of the hat 13 is deflected downward and greater illumination of proximal objects is achieved.

Figure 3:
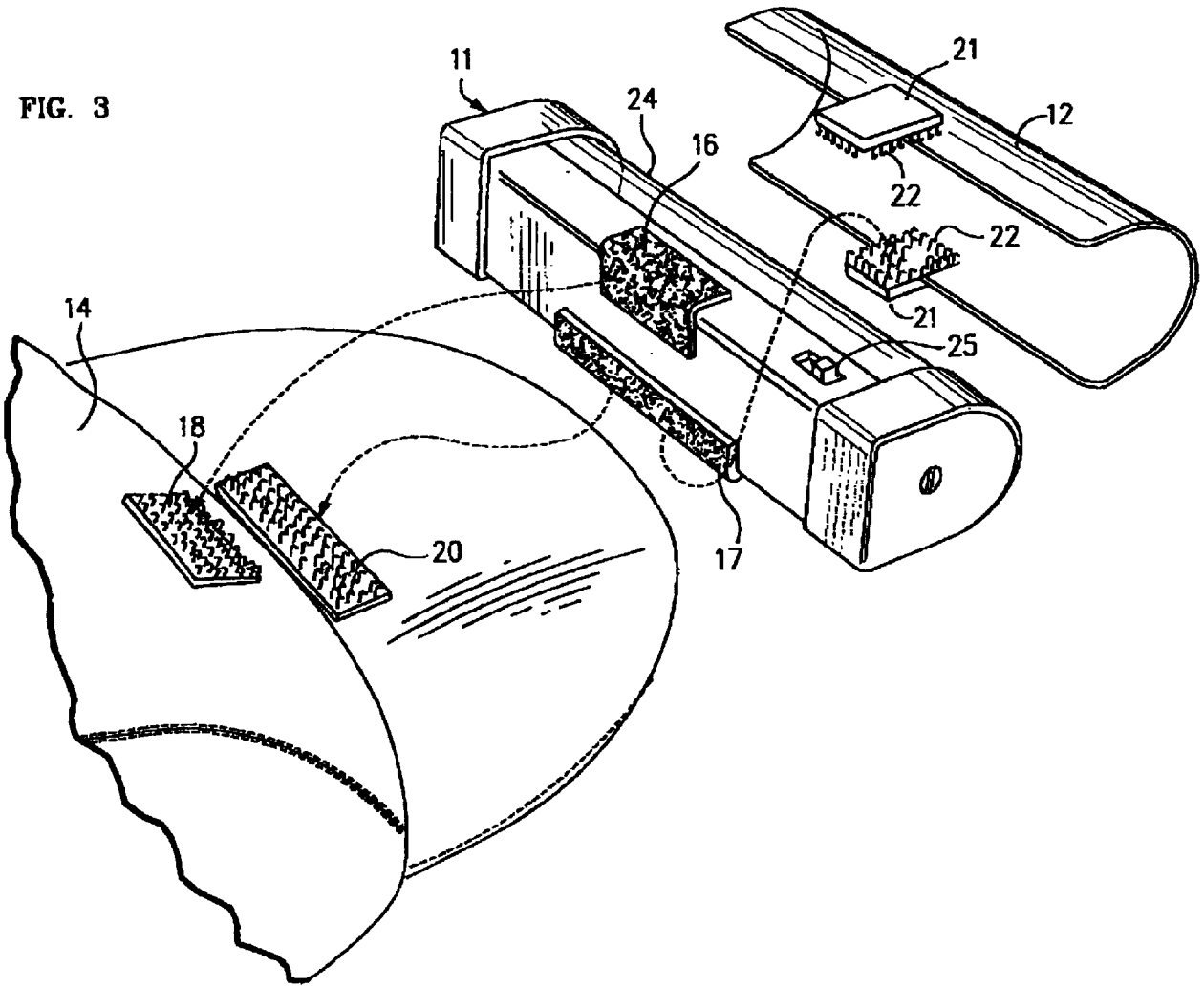
FIG. 3 is a sectional view illustrating in more detail the specific method for attaching each separate and removable member including removable lens cover 12.

FIG. 3 illustrates the transparent lens cover 12 with the centrally positioned and opposingly attached segments of loops 21 to hooks 22 at both the top and bottom. Both segments of hooks are partially attached inside the lens cover 12 to engage the segment of loops 16 and the segment of loops 17, while the segment of loops 21 is outside the lens cover to engage the segment of hooks 20 sewn to the bill 15 of the hat 13, as demonstrated in FIG. 2.

FIG. 3 demonstrates the position of the switch 25, which is positioned free from the attachment of the optional lens cover 12 to the lighting device 11.

Further illustrated in FIG. 3 is the approximate length of each segment of loops and hooks. It will be noted that the segment of hooks 20 sewn to the bill of the hat 13 is shorter than the segment of loops 17 attached to the lighting device 11. Similarly, the segment of hooks 18 sewn to the crown of the hat 14 is shorter than the segment of loops 16 attached to the lighting device 11. Experience has shown that with repeated removal of the light from the hat 13, separation of the adhesively attached loops from the body of the light may occur unless the segment of hooks is shorter than the segment of loops.

The lens cover 12 may serve to protect the lens shield 23 of the lighting device 11. In addition, the transparent lens cover 12 may contain various colored pigments or other components. An example would be a red pigment which would further preserve night vision by protecting the rods and cones of the retina of airplane pilots, yet still provide sufficient illumination with which to read instruments. It could also be used, for example, in film developing enclosures.

FIGS. 4 and 5 demonstrate two variations of the present invention. In FIG. 4, a single tubular light emitting diode array is positioned, facing forward, in housing 19 of lighting device 11. Positioned on the top surface of housing 19 is the on/off switch 25 which is electrically connected to the batteries 26 and light emitting diode 32. End caps 36 are positioned on either side of housing 19 being removable to gain access to the battery storage compartment for replacing exhausted power cells (batteries) 26. Also shown are the segments of loops 21 secured to lens cover 12 and segments of hooks 22 secured to housing 19 which are intended to engage each other for the purpose of placing over and alternately removing lens cover 12 from the lighting device 11.

In FIG. 5, an alternate variation is shown, where illustrated is two or more light emitting diode arrays, facing forward and positioned in housing 19 of lighting device 11. Positioned on the top surface of housing 19 is the on/off switch 25 which is electrically connected to the batteries 26 and light emitting diodes 34. End caps 36 are positioned on either side of housing 19 being removable to gain access to the battery storage compartment for replacing exhausted power cells (batteries) 26. Also shown are the segments of loops 21 secured to lens cover 12 and segments of hooks 22 secured to housing 19 which are intended to engage each other for the purpose of placing over and alternately removing lens cover 12 from the lighting device 11.

We claim:

1. A lighting apparatus for illuminating darkness which comprises:

a hat having a crown and a bill;

said hat having a first series of fixedly attached hooks engaged to said crown and said bill; and a light emitting diode lighting device having a second series of fixedly attached hooks which is removably attached to said first series of fixedly attached hooks.

2. The lighting apparatus as defined in claim 1, further comprising a lens cover having a third series of fixedly attached hooks which is removably attached to said first series of fixedly attached hooks.

3. The lighting apparatus as defined in claim 1, wherein said first series of fixedly attached hooks on said hat are shorter then said second series of fixedly attached hooks on said lighting device.

4. The lighting apparatus as defined in claim 1, wherein said light emitting diode lighting device comprises a single array of light emitting diodes.

5. The lighting apparatus as defined in claim 1, wherein said light emitting diode lighting device comprises a plurality of light emitting diode arrays.

6. The lighting apparatus as defined in claim 1, wherein said light emitting diode lightning device includes one or more light emitting diodes.

7. The lighting apparatus as defined in claims 4 or 5 wherein said array of light emitting diodes emanates a single color spectrum.

8. The lighting apparatus as defined in claim 4 or 5 wherein said array of light emitting diodes emanates more than one color spectrum.

9. The lighting apparatus as defined in claim 1, wherein said first series of fixedly attached hooks are mounted to said hat by sewing means.

10. The lighting apparatus as defined in claim 1, wherein said second series of fixedly attached hooks are mounted to said lighting device by sewing means.

11. The lighting apparatus as defined in claim 1, wherein said first series of fixedly attached hooks are mounted to said hat by adhesive means.

12. The lighting apparatus as defined in claim 1, wherein said second series of fixedly attached hooks are mounted to said lighting device by adhesive means.

13. The lighting apparatus as defined in claim 2, wherein said lens cover may be pigmented to obstruct certain wave lengths of light.

14. A lighting apparatus for illuminating darkness which comprises:

a hat having a crown and a bill;

wherein a light emitting diode lighting apparatus that is contained within a single housing is permanently attached to said crown of said hat; and a lens cover having a series of fixedly attached hooks which is removably attached to a series of fixedly attached loops on said lighting device.

15. A lighting apparatus for illuminating darkness which comprises:

a hat having a crown and a bill;

a light emitting diode lighting apparatus that is contained within a single housing that is permanently attached to said crown of said hat; and wherein said light emitting diode lighting device comprise a plurality of light emitting diodes; and said light emitting diodes emanating more than one color spectrum.

16. A lighting apparatus for illuminating darkness which comprises:

a hat having a crown and a bill;

a light emitting diode lighting apparatus that is contained within a single housing that is permanently attached to said crown of said hat;

a lens cover having a series of fixedly attached hooks which is removably attached to a series of fixedly attached loops on said lighting device; and said lens cover pigmented to obstruct certain wavelengths of light.

17. A lighting apparatus for illuminating darkness which comprises:

a hat having a crown and a bill;

said hat having a first series of fixedly attached hooks engaged to said crown and said bill;

a housing assembly having a series of attached loops for removably attaching to said hat;

one or more batteries positioned within said housing assembly;

one or more light emitting diodes located inside said housing assembly; and a switch electrically connecting said batteries to said light emitting diodes.

18. A lighting apparatus for illuminating darkness which comprises:

a hat having a crown and a bill;

a light emitting diode lighting apparatus that is contained within a single housing that is permanently attached to said crown of said hat;

wherein said light emitting diode lighting device comprise at least a single array of light emitting diodes; and said array of light emitting diodes emanating more than one color spectrum.

* * * * *